US010246882B2

(12) United States Patent
Taing

(10) Patent No.: US 10,246,882 B2
(45) Date of Patent: Apr. 2, 2019

(54) STRUCTURAL WALL PANEL SYSTEM

(71) Applicant: Kong Taing, Lowell, MA (US)

(72) Inventor: Kong Taing, Lowell, MA (US)

( * ) Notice: Subject to any disclaimer, the term of this patent is extended or adjusted under 35 U.S.C. 154(b) by 0 days.

(21) Appl. No.: 15/348,626

(22) Filed: Nov. 10, 2016

(65) Prior Publication Data

US 2017/0130463 A1 May 11, 2017

Related U.S. Application Data

(60) Provisional application No. 62/253,359, filed on Nov. 10, 2015.

(51) Int. Cl.
*E04F 13/08* (2006.01)

(52) U.S. Cl.
CPC ..... *E04F 13/081* (2013.01); *E04F 13/083* (2013.01); *E04F 13/0894* (2013.01)

(58) Field of Classification Search
CPC ... E04F 13/081; E04F 13/0894; E04F 13/083; E04B 1/40
See application file for complete search history.

(56) References Cited

U.S. PATENT DOCUMENTS 3,760,548 A 9/1973 Sauer et al.
4,307,551 A * 12/1981 Crandell ..... E04F 13/0808 52/204.591
5,301,484 A * 4/1994 Jansson ..... E04F 13/145 52/122.1
5,425,210 A 6/1995 Zafir
5,860,257 A 1/1999 Gerhaher et al.
6,098,364 A * 8/2000 Liu ..... E04F 13/0855 52/235
6,098,365 A 8/2000 Liu
6,253,511 B1 * 7/2001 Boyer ..... E04C 2/292 52/235
6,279,287 B1 8/2001 Meadows
6,823,638 B2 11/2004 Stanchfield
7,748,182 B2 7/2010 McGee et al.
8,117,801 B2 * 2/2012 Jambois ..... E04F 13/0864 52/519
8,316,598 B2 11/2012 Flynn et al.
8,468,765 B1 * 6/2013 Kim ..... E04F 13/0835 52/235
8,640,399 B2 2/2014 Fradera Pellicer
9,938,725 B2 * 4/2018 Johnson ..... E04F 13/0876
2006/0010820 A1 1/2006 Schwitte et al.
2009/0272055 A1 11/2009 Griffiths
(Continued)

FOREIGN PATENT DOCUMENTS

CH 639454 A5 * 11/1983 ..... E04F 13/0805
CN 1515769 A 7/2004
(Continued)

*Primary Examiner* — Babajide A Demuren
(74) *Attorney, Agent, or Firm* — Barlow, Josephs & Holmes, Ltd.

(57) ABSTRACT

A composite wall system is provided that employs a single thermally efficient edge extrusion. The present composite wall system does not use sealant at panel joints, is relatively lighter, and experiences substantially little to no thermal bridging found in conventional systems. It provides for an adjustable attachment system to allow panels to be adjusted to maintain optimal spacing along the panel margins and panel seal.

10 Claims, 5 Drawing Sheets

(56) References Cited

U.S. PATENT DOCUMENTS

| | | | | |
|---|---|---|---|---|
| 2014/0150614 | A1* | 6/2014 | Aboukhalil | E04F 13/007<br>83/39 |
| 2017/0073976 | A1* | 3/2017 | Nelson | E04F 13/0825 |

FOREIGN PATENT DOCUMENTS

| | | | | |
|---|---|---|---|---|
| DE | 4004103 | A1 * | 8/1991 | B32B 7/12 |
| EP | 0983406 | A1 | 3/2000 | |
| EP | 2189589 | A1 | 5/2010 | |
| EP | 2446095 | A1 | 5/2012 | |
| EP | 2530218 | A2 | 12/2012 | |
| KR | 1597681 | B1 * | 2/2016 | |
| KR | 1662780 | B1 * | 6/2016 | |
| TW | 200837257 | A | 9/2008 | |
| WO | WO 2015168745 | A1 * | 11/2015 | E04F 13/0825 |

* cited by examiner

STRUCTURAL WALL PANEL SYSTEM

CROSS-REFERENCE TO RELATED APPLICATIONS

This application is related to and claims priority from earlier filed U.S. Provisional Patent Application No. 62/253,359, filed Nov. 10, 2015.

BACKGROUND OF THE INVENTION

The present invention relates to a unitized/panelized wall system and the joints utilized therein. More specifically, the present invention relates to a modular wall construction system that facilitates assembly of unitized wall panels in the shop having a unique interfitting panel joint that facilitates reduced erection and assembly labor in the field.

Architectural panels, such as utilized in exterior building envelope construction, have been in use for a number of years. Conventional exterior building envelope construction can be categorized into three basic construction categories: (1) stick-built construction, (2) unitized curtain wall construction, and (3) panelized wall construction.

Stick-built construction is a relatively old technology. In stick-built construction, a structure is assembled piece-by-piece at a worksite, with little or no prefabrication of the structure into subassemblies prior to delivery of the construction materials to the site. For example, conventional residential/commercial utilize stick-built construction techniques. Conventional stick-built construction can provide a number of benefits. For example stick-built construction is adaptable to customization, relies on the talent of the craftsmen, and is substantially weather dependent in nature.

Unitized curtain wall construction has been in use over the last half-century. Conventional unitized curtain wall assemblies include a combination of glass, mullions, and gaskets, where the glass and aluminum mullions are prefabricated (e.g., shop assembled) offsite. Conventional unitized curtain wall construction can provide a number of benefits. For example, because the assemblies are typically manufactured in a controlled environment (i.e., within a shop rather than on-site), unitized curtain wall construction techniques provide relatively high-quality assemblies.

Panelized wall construction has been in use over the last two decades. Conventional panelized wall construction has replaced some of the stick-built construction in certain scenarios, such as in brick walls, metal panel walls, and corrugated metal walls, for example. Conventional panelized wall assemblies are typically utilized in cases where a wall is not required to be configured as an all-glass wall type. The design includes conventional design components such as heavy structural steel, light gage meal framing, sheathing, air-and-vapor barrier sheets, insulation, sub-girts, and sealant, for example.

Conventional exterior building envelope construction techniques suffer from a variety of deficiencies. For example, stick-built construction is relatively slow and costly to build, and can have variable quality control issues. For unitized curtain wall construction, due to the fundamental basis of the design, conventional unitized curtain wall assemblies typically include a relatively low (i.e., poor) R-Value, such as an effective R-Value of between about 1 and 3, which is due to thermal bridging through aluminum 'box' mullions. Further, conventional unitized curtain wall constructions are limited in sizes to approximately five feet (5') in width.

For panelized wall construction, due to the fundamental basis of the design, conventional panelized wall assemblies include sub-girts having relatively poor thermal bridging (e.g., per ASHREA) and sealant uses at transition joints which requires maintenance, for example. Further, conventional panelized wall assemblies are relatively heavy, have a relatively thick wall depth (12" to 18"), a relatively low (i.e., poor) R-Value, such as an effective R-Value of between about 4 and 12. Effectively, the panelized wall construction is the same construction method as conventional stick-built constructions. However, panelized wall assemblies are manufactured in a controlled environment, rather than on-site. This provides relatively higher quality, yet relatively poor performance.

By contrast to conventional exterior building envelope construction techniques, embodiments of the present innovation relate to a unitized wall panel assembly. In one arrangement, the unitized wall panel assembly is a composite wall system configured to distribute and transfer loads, such as wind loads, through a composite action between the unitized wall panels and the studs of the assembly. Further, the joint design of the composite wall system provides an increase in thermal performance compared to conventional system. For example, the unitized wall panel assembly provides a substantially large thermal R-Value (e.g., an effective R-Value of about 19 or more per ASHREA) for about half the wall depth of conventional panel wall systems. The design is based upon the interaction among an insulated wall panel, thermally efficient joints, and the finish cladding, such as specified by an architect.

BRIEF SUMMARY OF THE INVENTION

In this regard, the present invention provides a unitized wall panel assembly that consists of a composite wall system configured to distribute and transfer loads, such as wind loads, through a composite action between the unitized wall panels and the studs of the assembly. Further, the joint design of the composite wall system provides an increase in thermal performance compared to conventional system.

In accordance with the present invention a unitized wall panel assembly construction provides benefits relative to the aforementioned construction types. For example, the conventional unitized curtain wall systems rely on, as a minimum, a two-piece extrusion to capture glass and transfer design load. By contrast the present composite wall system uses a single thermally efficient extrusion. Further, the conventional unitized curtain wall systems are not designed to allow attachment of brick or other exterior veneer to attach to it, contrary to the present composite wall system.

In another example, the panelized wall system relies on sealant at the joint locations which require maintenance, are heavy, expose the associated insulation to the weather and elements, and function poorly from a thermal standpoint. By contrast, the present composite wall system does not use sealant at panel joints, is relatively lighter, and experiences substantially little to no thermal bridging found in conventional systems.

It is therefore an object of the present invention to provide a panelized wall system that includes an integrated edge sealing joint to eliminate the need for sealant at the panel joints. It is a further object of the present invention to provide a panelized wall system that includes an adjustable mounting system that facilitates ease of installation and an ability to adjust the panel positions relative to one another in order to optimize the performance of the integrated edge sealing joint.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
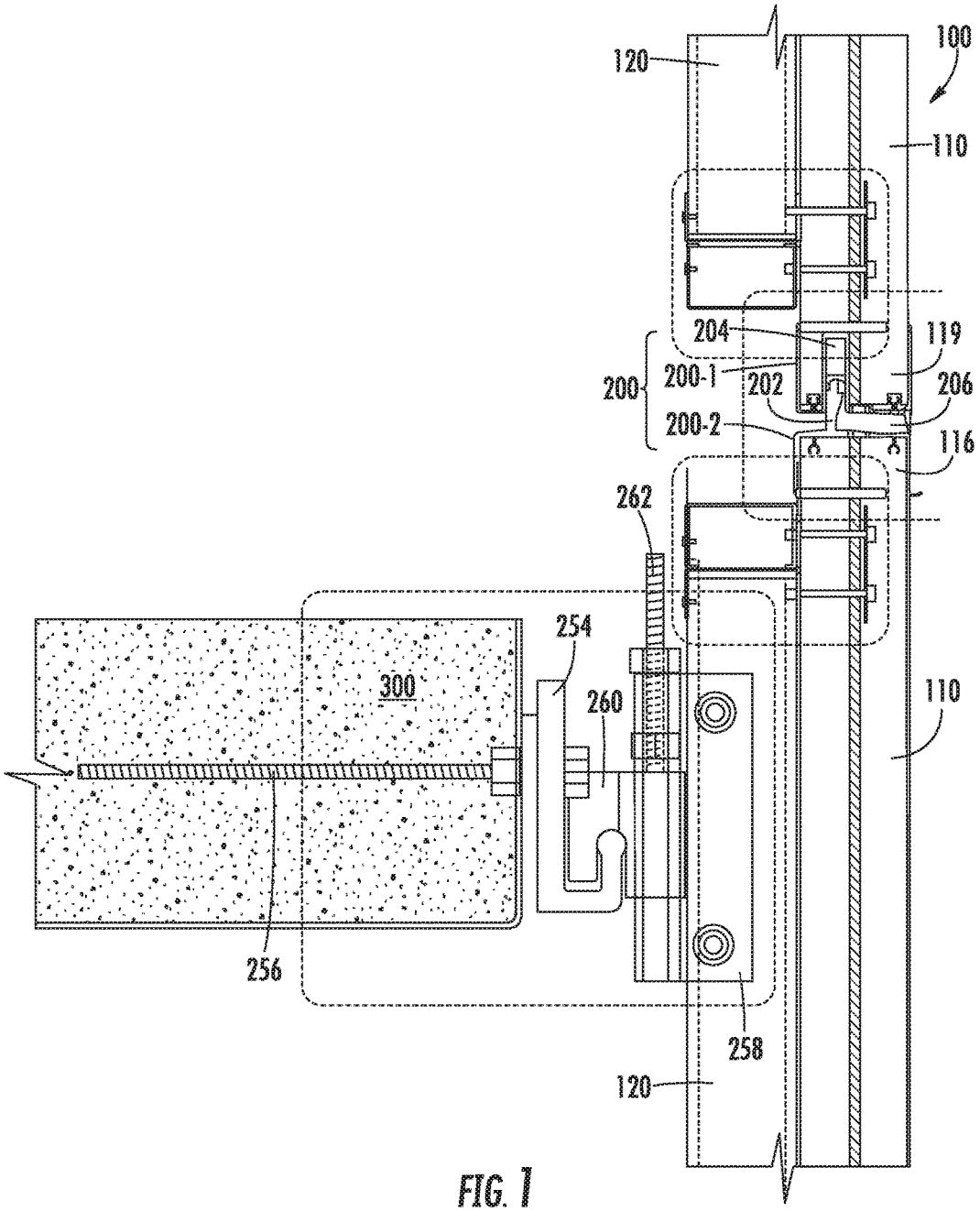
FIG. 1 illustrates a side sectional view of a wall panel construction in accordance with the present disclosure.

Now referring to the drawings, embodiments of the present innovation are disclosed that relate to a unitized wall panel assembly. In one arrangement, the unitized wall panel assembly is a composite wall system configured to distribute and transfer loads, such as wind loads, through a composite action between the unitized wall panels and the studs of the assembly. Further, the joint design of the composite wall system provides an increase in thermal performance compared to conventional system. For example, the unitized wall panel assembly provides a substantially large thermal R-Value (e.g., an effective R-Value of about 19 or more per ASHREA) for about half the wall depth of conventional panel wall systems. The design is based upon the interaction among an insulated wall panel, thermally efficient joints, and the finish cladding, such as specified by an architect. Accordingly, the composite wall system provide relatively high strength with a smaller wall depth, less weight, and an increase in thermally efficiency compared to conventional construction methods.

Conventional wall panels in the prior art are configured to be disposed on an exterior of a building, such as part of an external façade. The wall panel is typically configured as a substantially rectangular structure defining a longitudinal axis. In one arrangement, the panel is constructed from a foam insulation material, such as a substantially continuous polyisocyanurate insulation material with varying thicknesses. In one arrangement, the wall panel is configured to interlock with adjacently disposed panels to form a substantially continuous insulating structure. Opposing edges of a wall panel define an interlocking splined structure.

In a conventional installation of the wall panels at a work site, studs, such as six inch C-studs, extend vertically relative to a structure. During an assembly procedure, an assembler typically disposes a wall panel relative to the studs such that the longitudinal axis of each panel is substantially perpendicular to the longitudinal axis of each stud. The assembler then secures the wall panel to each of the studs using a fastener and interlocks a subsequent wall panel with the splined structure of the previously secured wall panel.

This conventional layout of the wall panels relative to the studs provides insulation to a building structure. However, such a layout suffers from a variety of deficiencies. For example, when exposed to a wind load, the insulated wall panels do not assist in composite action with that of the studs in transferring the load. Based upon the multipoint connections between the wall panels and studs, when exposed to a loading (e.g., a loading substantially perpendicular to the face of the wall panels, such as caused by the wind) the wall panels transfer the load to the studs.

By contrast, FIG. 1 illustrates an example of a composite wall system 100, according to one arrangement of the innovation. The system 100 is configured to allow the mounting of insulated wall panels 100 in a unitized configuration to an edge-of-slab condition. In such an arrangement, each of the wall panels 100 can span a distance floor-to-floor without requiring any additional support framing.

Figure 2:
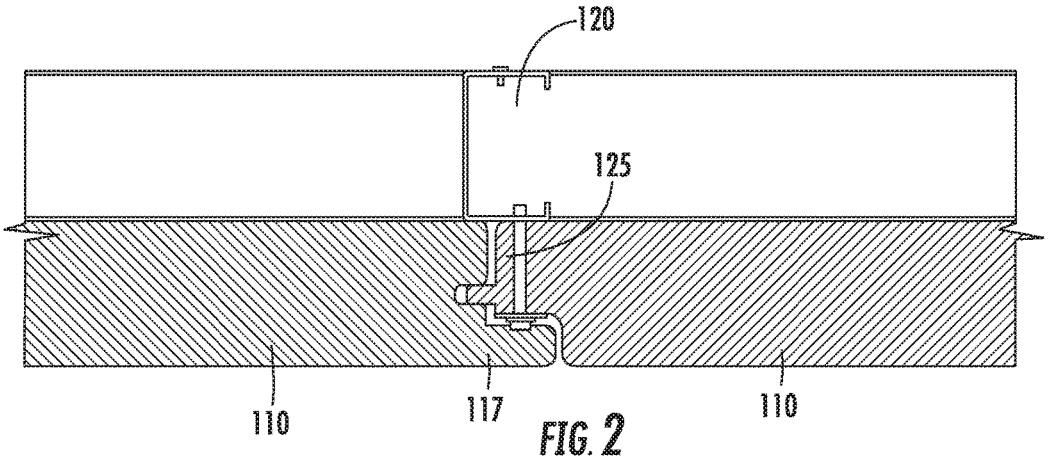
FIG. 2 illustrates an edge joint detail showing a panel joint in accordance with the wall panel construction of the present disclosure.

For example, the system 100 includes a set of panels 110 and a set of studs 120. Each panel of the set 110 is configured as an insulated panel having an interlocking or splined structure formed at the joint 117 between edges 114, 116 of adjacent panels 110. The wall panels 110 are disposed such that the longitudinal axis of each panel 110 is substantially parallel to the longitudinal axis of each stud 120. The edge material at a joint 117 of two adjacent wall panels 110 is coupled to a corresponding stud 122 along the longitudinal axis of the stud. An example of such coupling using fasteners 125 is shown in FIG. 2.

Attachment of the horizontal panel-to-panel joints 117 to the relatively light gauge metal stud 120 combines the strength of both the wall panels 110 and the studs 120 so that they act as a composite structure to support and transfer loads. For example, based upon the longitudinal connections between the wall panels 110 and studs 120, when exposed to a loading (e.g., a loading substantially perpendicular to the face of the wall panels 110, such as caused by the wind) the combination of the wall panels 110 and the studs 120 act to absorb the loading. Additionally, the positioning of the longitudinal axis 112 of the wall panels 110 substantially parallel to the longitudinal axis 122 of the studs 120 minimizes external loading (e.g., a wind load).

Further, the composite wall system is configured to provide a substantially large thermal R-Value (e.g., an effective R-Value of about 19 or more per ASHREA) for about half the wall depth of conventional panel wall systems.

Figure 3:
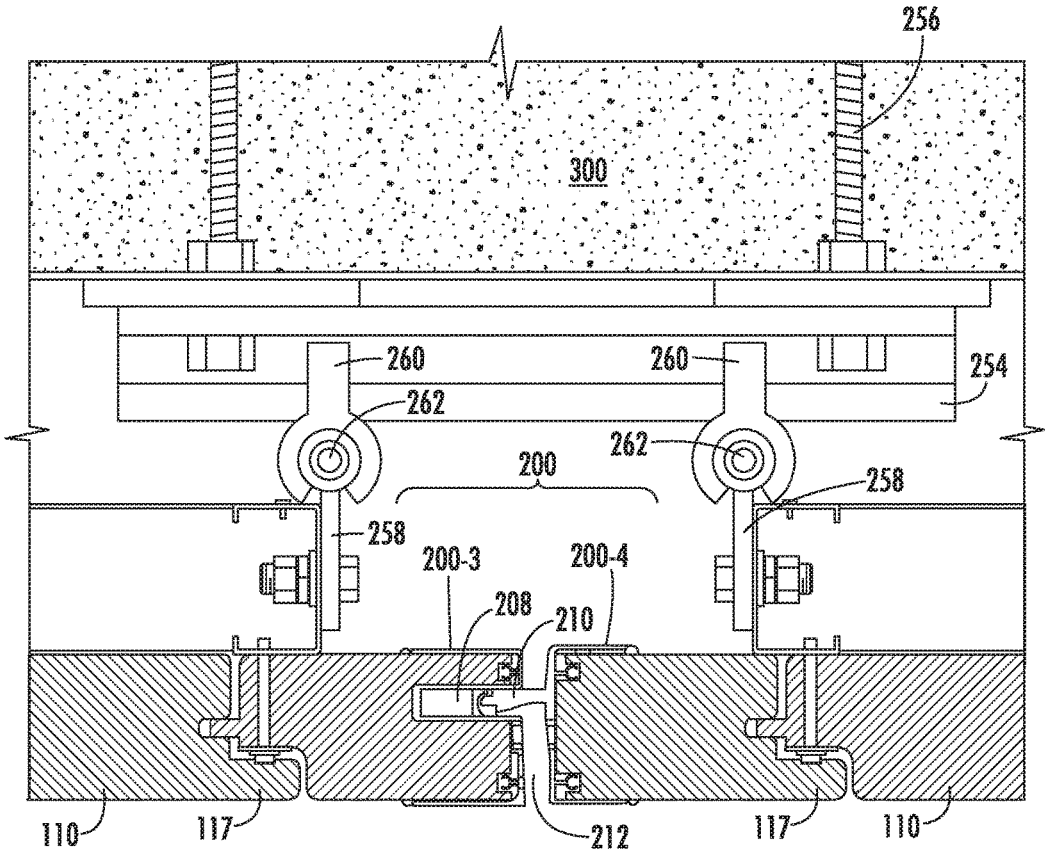
FIG. 3 illustrates a top sectional view of a wall panel construction in accordance with the present disclosure.
Figure 4:
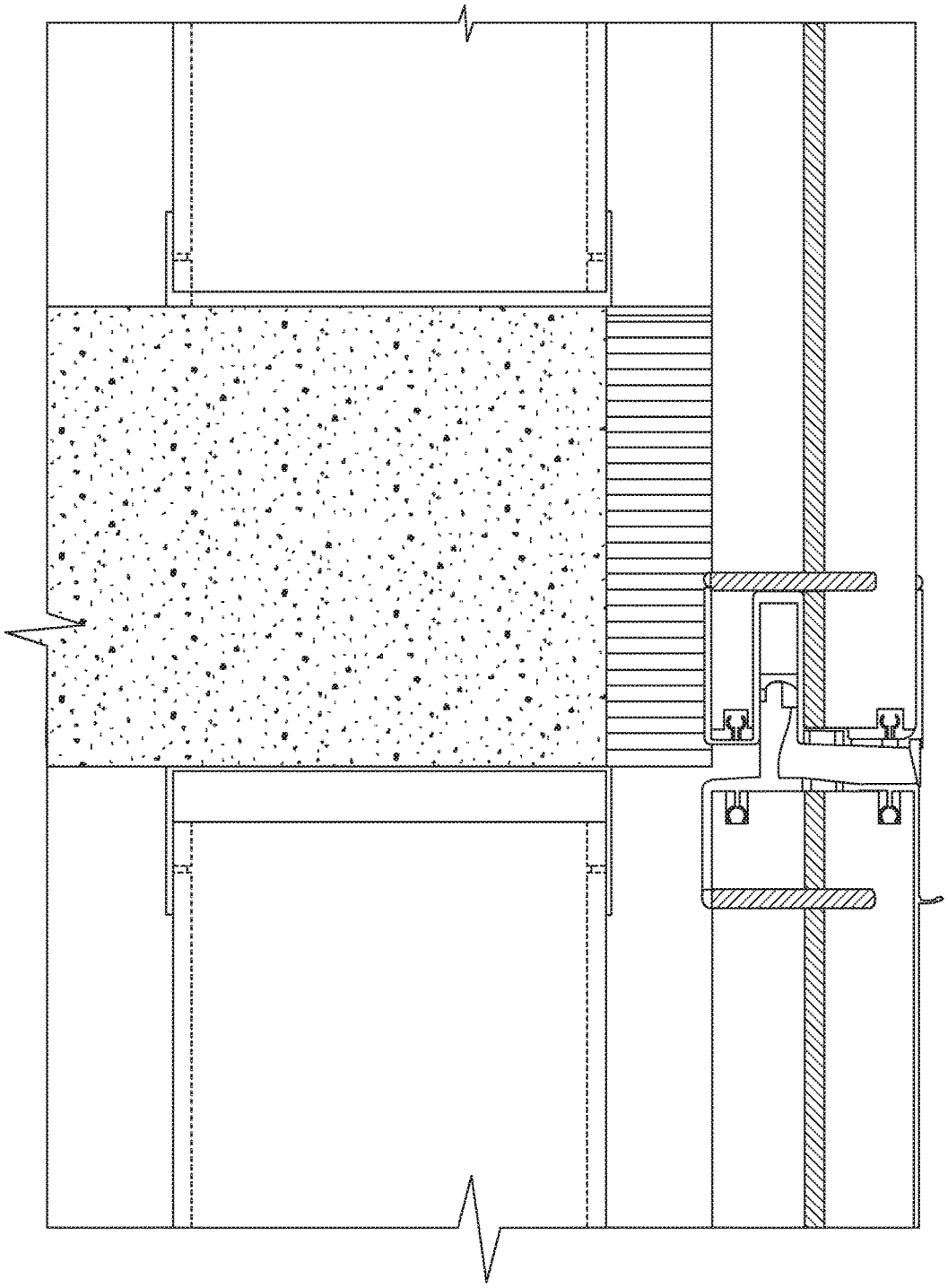
FIG. 4 illustrates a side sectional view of an alternate arrangement wall panel construction in accordance with the present disclosure.

Turning back to FIG. 1, in one arrangement, the wall panel 110 can include an extrusion assembly that extends around at least a portion of wall panel perimeter. For example, a wall panel can be configured with opposing extrusion assemblies on the panel's top and bottom edges (i.e. horizontal extrusions), on the panel's right and left side edges (vertical extrusions), or with an extrusion assembly 200 extending around the entire perimeter of the wall panel 110 (vertical and horizontal extrusions), as illustrated in FIGS. 1 and 3. In each case, the extrusion assembly 200 is configured to provide ease of assembly of the wall panels 110 in the field and to allow relative movement of the wall panels 110 once installed on a structure.

As can be seen the wall panels 110 each having horizontal extrusions 200-1, 200-2 extending along opposing top and bottom edges. The extrusions 200-1, 200-2 are configured to allow mounting of panels 110 to a wall which allows relative horizontal and vertical movements between adjacent panels 110. While the horizontal extrusions 200-1, 200-2 can be configured in a variety of ways, in one arrangement, the first wall panel 110-1 includes a first extrusion 200-1 disposed on a top edge where the first extrusion 200-1 includes a male component 202 which extends along the length of the wall panel 110-1. Further, the second wall panel 110-2 includes a second extrusion 200-2 disposed on a bottom edge where the second extrusion 200-2 defines a channel or female component 204 which extends along the length of the wall panel 110-2. Interconnection of the male and female components of the first and second extrusions 200-1, 200-2 couples the opposing wall panels 110-1, 110-2 to each other. When interconnected, the extrusions 200-1, 200-2 define a space or gap 206 between opposing wall panels 110-1, 110-2 of between about zero inches and 1.5 6 inches. This separation gap 206 isolates the wall panels 110-1, 110-2 from a building or structure 300 and allows for horizontal and vertical building movements while maintaining the integrity of the insulated wall panels 110-1, 110-2 as well as the building envelope's air, vapor, and weather barriers.

Figure 6:
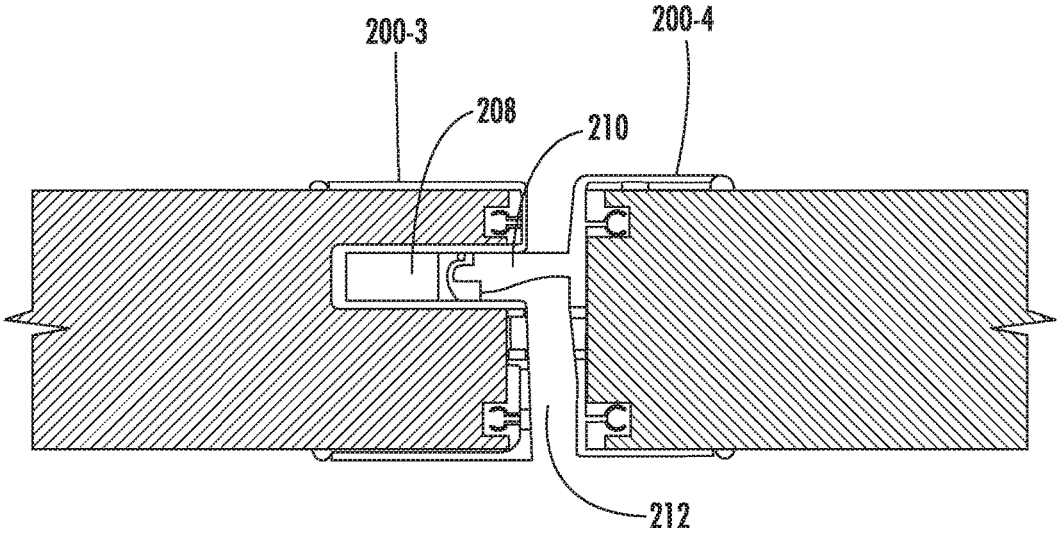
FIG. 6 depicts an edge detail for a wall panel construction in accordance with the present disclosure.

FIG. 6 illustrates a top sectional view of adjacent wall panels 110-3, 110-4, each having a vertical extruded perimeter 200-3, 200-4, according to one arrangement. As illustrated, the extruded perimeter 200-3 defines a channel of female component 208 while the extruded perimeter 200-4 includes a male component 210. When interconnected, the extrusions 200-3, 200-4 define a space or gap 212 between opposing wall panels 110-3, 110-4 of between about zero inches and 6 inches. This separation gap 212 isolates the wall panels 110-3, 110-4 from the building or structure 300 and allows for vertical building movement while maintaining the integrity of the insulated wall panels 110-3, 110-4 as well as the building envelope's air, vapor, and weather barriers.

The wall panel assemblies 110, such as provided above, can be secured to a building face in a number of ways. The following provides two example wall panel mounting assemblies that can be utilized to tie the wall panel assemblies 110 to a building face.

FIGS. 1 and 3 illustrate an example of wall panels 110 mounted to the slab edges 250 of a building where the wall panel mounting assembly is configured as a J-bracket assembly 252. For example, the J-bracket assembly 252 is designed for mounting insulated wall panel assemblies 110, in a unitized configuration, to a slab edge 300 and to span the wall panel assemblies 110 floor-to-floor without requiring any additional support framing.

The J-bracket assembly 252 includes a slab edge "J" hanger bar 254 that is attached to fasteners such as threaded rods 256 which are embedded in the concrete slab 250. The J-bracket assembly 252 also includes a jamb plate 258, a sliding clip 260, and an adjustment bolt 262 that are configures to support the load of the wall panels 110 and transfer the loads to the building structure 300. The J-bracket assembly 252 is disposed at the top and bottom slab edges 300 of the building structure and combines with the strength the wall panel assemblies 110 so that they act compositely to support all imposed loads.

Figure 5:
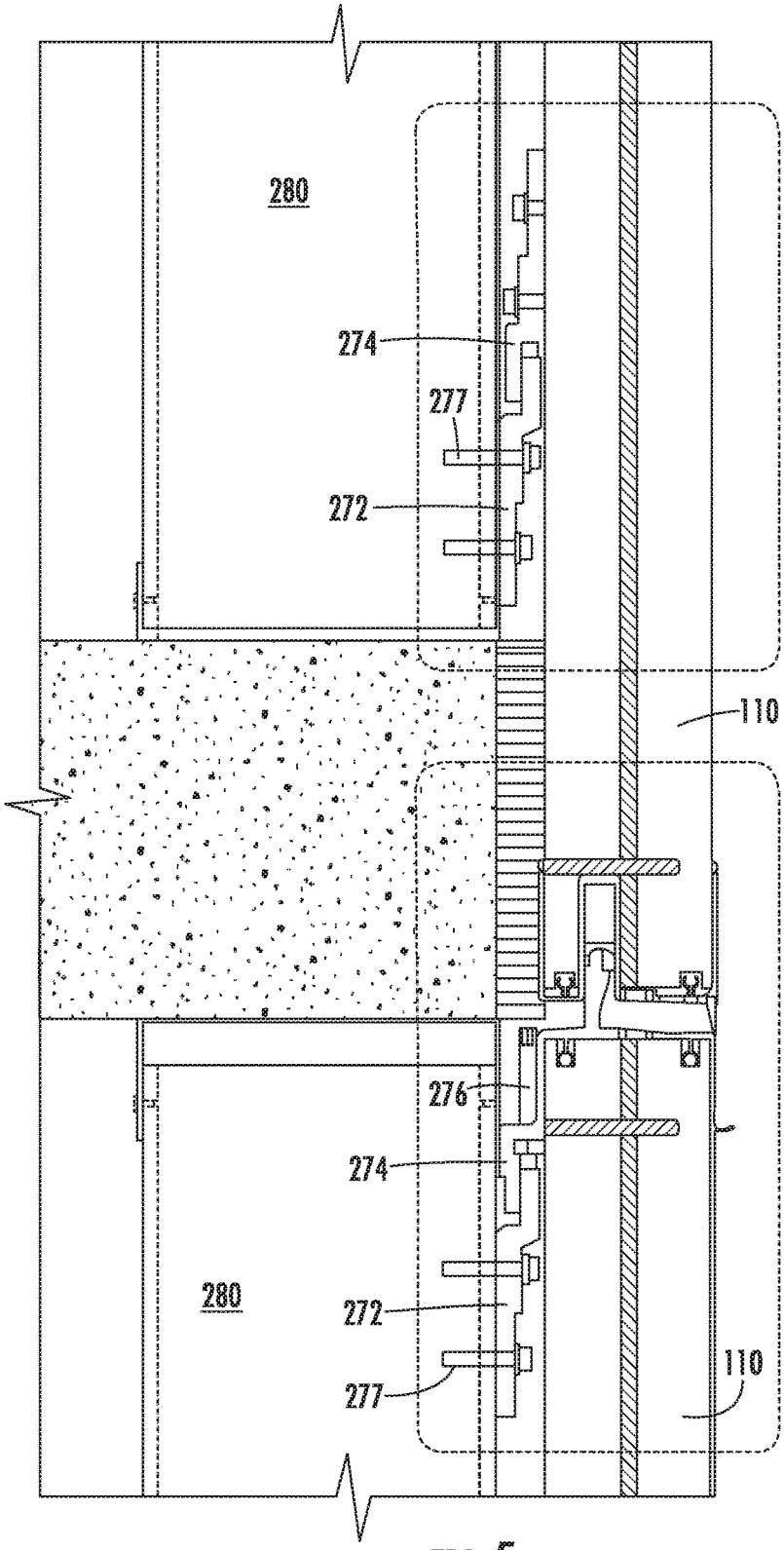
FIG. 5 illustrates a side sectional view of an alternate mounting arrangement for a wall panel construction in accordance with the present disclosure.

FIG. 5 illustrates a set of wall panels 110 mounted to an existing wall. While the wall panels 110 can be mounted in a variety of ways, in one arrangement, the wall panels mount utilizing a set of Z-bracket assemblies. In one arrangement, the Z-bracket assembly 270 includes a first or bottom z-shaped extrusion 272 and a second or top z-shaped extrusion 274 that interact to secure each wall panel 110-1, 110-2 to a corresponding wall 280-1, 280-2.

In one arrangement, the top extrusion 274 includes adjustable setting fasteners 276, such as bolts, that secure the top extrusion 274 to the corresponding wall panel 110-1. The fasteners 276 are configured to support the weight of the panel assemblies 110 and allow for vertical adjustment of the unitized panel sections 110 during installation. The bottom extrusion 272 is configured to be secured to a wall structure 280 of a building, such as via fasteners 277.

The top extrusion 274 works in conjunction with the bottom extrusion 274 to transfer the weight of the panel 110 to the building structure 280. For example, a portion of the top extrusion 274 is disposed within a gap defined between the bottom extrusion 272 and the wall 280 while a portion of the bottom extrusion 272 is disposed within a gap defined between the top extrusion 274 and the wall panel assembly 110. Accordingly, the top and bottom extrusions 274, 272 interlock together to transfer horizontal loads to the building structure 280 while allow for vertical building movements.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A composite panel wall system for spanning from floor to floor in a building structure, comprising:

a plurality of structural framing members, each having a longitudinal axis;

a plurality of insulated wall panels, each having a periphery edge and a longitudinal axis, each of said wall panels being affixed to at least one of said framing members wherein the longitudinal axis of each wall panel is aligned with the longitudinal axis of each framing member;

a first edge extrusion having a protruding male extension extending therefrom with a sealing gasket affixed thereto, said first extrusion received about at least a portion of said periphery edge;

a second edge extrusion having a channel seal element received about a remaining portion of said periphery edge;

a jamb tab affixed to a rear surface of each of said panels;

a clip on a threaded vertical connector affixed to said jamb tab; and a channel configured to be affixed to a building structure, wherein said sliding clip engages with said channel to support said panel on said building structure in a vertically adjustable fashion, and wherein said first edge extrusion on a first of said plurality of panels interfits with said second edge extrusion on a second of said plurality of panels positioned adjacent said first panel such that a space left between said adjacent first and second panels allows expansion and contraction wherein said male extension moves within said channel to maintain a seal despite said expansion and contraction.

2. The composite panel wall system of claim 1, wherein said first edge extrusion is received about a top periphery edge of each of said wall panels and said second edge extrusion is received about a bottom periphery edge of each of said wall panels.

3. The composite panel wall system of claim 2, wherein said first edge extrusion is received about one side periphery edge of each of said wall panels and said second edge extrusion is received about an opposing side periphery edge of each of said wall panels.

4. The composite panel wall system of claim 1, wherein said first edge extrusion is received about one side periphery edge of each of said wall panels and said second edge extrusion is received about an opposing side periphery edge of each of said wall panels.

5. The composite wall system of claim 1, further comprising:

stud framing members attached to each of said insulated wall panels.

6. The composite wall system of claim 1, wherein said jamb tab and sliding clip are adjustable connected using a bolt.

7. The composite wall system of claim 1, wherein said jamb tab and sliding clip can be adjusted vertically relative to one another.

8. A composite panel wall system comprising:

a plurality of insulated wall panels, each having a back surface a longitudinal axis and a periphery edge;

stud framing members having a longitudinal axis attached to said back surface of each of said insulated wall panels wherein the longitudinal axis of each wall panel is aligned with the longitudinal axis of each framing member;

a first edge extrusion having a protruding male extension extending therefrom with a sealing gasket affixed thereto, said first extrusion therefrom received about at least a portion of said periphery edge;

a second edge extrusion having a channel seal element received about a remaining portion of said periphery edge;

a jamb tab affixed to a rear surface of each of said panels;

a clip on a threaded vertical connector affixed to said jamb tab; and a channel configured to be affixed to a building structure, wherein said sliding clip engages with said channel to support said panel on said building structure in a vertically adjustable fashion, and wherein said first edge extrusion on a first of said plurality of panels interfits with said second edge extrusion on a second of said plurality of panels positioned adjacent said first panel such that a space left between said adjacent first and second panels allows expansion and contraction wherein said male extension moves within said channel to maintain a seal despite said expansion and contraction.

9. The composite wall system of claim 8, wherein said jamb tab and sliding clip are adjustable connected using a bolt.

10. The composite wall system of claim 8, wherein said jamb tab and sliding clip can be adjusted vertically relative to one another.

* * * * *